US005188451A

United States Patent [19]

Shanks

[11] Patent Number: 5,188,451

[45] Date of Patent: Feb. 23, 1993

[54] ONE-PIECE SPACER END CAP FOR AN ELONGATED JACKETED DISCHARGE LAMP

[75] Inventor: Bruce E. Shanks, Circleville, Ohio

[73] Assignee: General Electric Company, Schenectady, N.Y.

[21] Appl. No.: 861,692

[22] Filed: Apr. 1, 1992

[51] Int. Cl.[5] ..... F21V 25/00

[52] U.S. Cl. ..... 362/223; 362/260; 362/294; 362/376

[58] Field of Search ..... 362/217, 223, 260, 376, 362/377, 378, 433, 457, 458, 294

[56] References Cited

U.S. PATENT DOCUMENTS

| | | | |
|---|---|---|---|
| 2,308,986 | 1/1943 | Livers | 362/260 |
| 3,358,167 | 12/1967 | Shanks | 313/25 |
| 3,453,470 | 7/1969 | Hammer | 313/25 |
| 3,673,401 | 6/1972 | Du Pont | 362/377 |
| 3,720,826 | 3/1973 | Gilmore et al. | 362/377 |
| 3,798,481 | 3/1974 | Pollara | 362/377 |
| 3,808,495 | 4/1974 | Win | 362/223 |
| 4,924,368 | 5/1990 | Northrop et al. | 362/223 |
| 5,045,756 | 9/1991 | Livera | 313/631 |

*Primary Examiner*—Richard R. Cole

*Attorney, Agent, or Firm*—Edward M. Corcoran; Stanley C. Corwin

[57] ABSTRACT

An elongated jacketed discharge lamp uses an improved spacer end cap in the form of a one-piece body of thermally insulating material having an annular ring-shaped side portion and an annular disk-shaped end portion integrally-connected therewith. The annular side portion has an annular interior wall surface defining a central cavity receiving and frictionally engaging at least the periphery of an end base on an end of an envelope tube of the jacketed lamp. The annular side portion also has an annular groove formed therein receiving and seating one end of an outer sleeve which surrounds the envelope tube of the jacketed lamp. The groove is defined by an outer annular wall surface which surrounds and frictionally engages the exterior of the one end of the outer sleeve and an inner annular wall surface spaced radially inwardly from the interior of the end of the outer sleeve away from frictional engagement therewith. The annular end portion has an annular inner rim defining a central aperture through which protrudes an annular contact pin-containing housing projecting from the end base on the envelope tube end. The annular inner rim sealably surrounds the annular housing and overlies a peripheral edge of the envelope tube end base.

14 Claims, 2 Drawing Sheets

ONE-PIECE SPACER END CAP FOR AN ELONGATED JACKETED DISCHARGE LAMP

BACKGROUND OF THE INVENTION

1. Field of the Invention

The present invention relates generally to an elongated jacketed low pressure discharge lamp, such as a fluorescent lamp, and, more particularly, is concerned with a one-piece spacer end cap for each end of the elongated jacketed discharge lamp.

2. Description of the Prior Art

The light output of any fluorescent lamp depends on the mercury vapor pressure inside the lamp. Optimum pressure for maximum light output for most fluorescent lamps occurs when the coolest spot on the lamp envelope tube is about 100°F. One important factor affecting lamp temperature is ambient temperature and wind draft conditions. As the lamp temperature is raised above 100°F., the mercury vapor pressure within the elongated discharge envelope tube of the lamp increases and light output and lamp wattage slowly drop. At lower lamp envelope tube temperatures, the mercury condenses on the tube, pressure drops, and light output falls sharply and wattage drops slowly. This effect of temperature on mercury vapor pressure and thereby on light output is common to all fluorescent lamp designs.

Fluorescent lamps are widely used in both indoors and outdoors applications. Problems typically encountered when using fluorescent lamps outdoors fall into two categories: starting and operating. Fluorescent lamps become harder to start when cold. Once started, successful operation depends on how hot the lamp becomes. Thus, for outdoor use, fluorescent lamps are commonly jacketed, employing an elongated outer light-transmitting glass sleeve disposed over the discharge envelope tube, to reduce heat loss from the tube and protect the tube from wind drafts.

Also, jacketed fluorescent lamps typically have end cap assemblies to shield and protect the ends of the lamp discharge envelope tube against cold wind drafts. Representative of the end cap assemblies used in the prior art are the ones disclosed in U.S. patents issued to Shanks (U.S. Pat. No. 3,358,167) and Hammer (U.S. Pat. No. 3,453,470) and assigned to the same assignee as the present invention. Each of these prior art end cap assemblies include an annular spacer of insulating material and an annular cup-shaped shell of thin sheet metal material. The annular insulating spacer fits on one end of the discharge envelope tube and has a narrow annular groove which receives and seats an end of the outer glass sleeve. The annular metal shell has an annular skirt or sidewall which is force-fitted about and grips the periphery of the annular insulating spacer to put the spacer, sleeve and envelope tube in compression to assure a rigid assembly. The shell also has a face or end wall which then overlies a base on the end of the discharge envelope tube sealing off any empty space. The end wall has a central aperture through which protrudes a contact housing projecting from the base of the tube end.

Overall, these lamp end cap assemblies have functioned satisfactorily in the low temperature environments in which they are designed to be used. However, it has been perceived by the inventor herein that it would be desirable to devise additional improvements in order to make it easier to seat the outer sleeve end in the annular insulating spacer groove and to reduce the number of parts and the amount of labor required to install the parts while retaining the wind draft shielding capability of the end cap.

SUMMARY OF THE INVENTION

The present invention provides an improved spacer end cap for each end of an elongated jacketed discharge lamp being designed to satisfy the aforementioned needs. A first improved feature incorporated by the spacer end cap of the present invention is the provision of a single or one-piece construction which reduces the number of parts required to be installed and thereby the complexity of the installation steps and the amount of time taken to carry the steps out. Another improved feature incorporated by the spacer end cap of the present invention is the provision of an annular groove which is oversized for receiving and seating one end of the outer sleeve in a fashion which eliminates the difficulty experience in the past with assembling the spacer to the end of the lamp. Still another improved feature incorporated by the spacer end cap of the present invention is the provision of an inner annular lip or rim for providing a seal with the base of the discharge envelope tube end.

Accordingly, the present invention is directed a spacer end cap for mounting to an end of an elongated jacketed discharge lamp. The spacer end cap comprises: (a) a one-piece body of insulating material having a central longitudinal axis and an annular ring-shaped side portion and an annular disk-shaped end portion integrally-connected therewith, the annular side and end portions disposed symmetrically about the longitudinal axis; (b) the annular side portion having an annular interior wall surface defining a central cavity capable of receiving and frictionally engaging at least a periphery of a base on an end of an envelope tube of the jacketed discharge lamp; (c) the annular side portion also having a spaced pair of outer and inner annular wall surfaces defining an annular groove therebetween capable of receiving and seating one end of an outer sleeve which surrounds the envelope tube of the jacketed lamp, the outer annular wall surface of the annular side portion being capable of surrounding and frictionally engaging the exterior of the one end of the outer sleeve as the inner annular wall surface of the annular side portion remains spaced radially inwardly from the interior of the end of the outer sleeve away from frictional engagement therewith; (d) the annular end portion defining a central aperture through which protrudes an annular contact-shielding housing projecting from the base on the envelope tube end.

The annular groove defines an annular gap in the annular side portion between the outer and inner annular wall surfaces thereof which has a width substantially greater than the thickness of the sleeve end. Also, the outer annular wall surface is greater in axial length than the inner annular wall surface along the longitudinal axis of the one-piece body.

The annular end portion has an annular inner rim defining the central aperture and sealably surrounding the annular housing. The annular inner rim overlies a peripheral edge of the envelope tube end base. Further, the central cavity defined by the annular side portion is greater in diameter than the central aperture defined by the annular end portion.

In one embodiment, the annular interior wall surface of the annular side portion defining the central cavity is of a constant diameter size along the longitudinal axis of the one-piece body. In a modified embodiment, the annular interior wall surface of the annular side portion defining the central cavity includes first and second tandemly-arranged annular interior wall surface portions. The first annular interior wall surface portion is capable of surrounding and frictionally engaging the periphery of the one end of the envelope tube. The second annular interior wall surface portion which is less in diameter than the first annular interior wall portion is capable of surrounding and frictionally engaging the periphery of the base on the one end of the envelope tube.

The present invention is also directed to the above-defined spacer end cap in combination with an elongated jacketed discharge lamp. The jacketed discharge lamp has an elongated discharge envelope tube, a base attached on opposite ends of the envelope tube, an annular electrical contact-shielding housing mounted on and protruding outwardly from the base end, and an outer light-transmitting sleeve having opposite ends and surrounding and spaced radially outward from the envelope tube.

These and other features and advantages and attainments of the present invention will become apparent to those skilled in the art upon a reading of the following detailed description, when taken in conjunction with the drawings, wherein there is shown and described an illustrative embodiment of the invention.

BRIEF DESCRIPTION OF THE DRAWINGS

In the following detailed description, wherein like reference characters designate like or corresponding parts throughout the several views, reference will be made to the attached drawings in which.

DETAILED DESCRIPTION OF THE INVENTION

Figure 1:
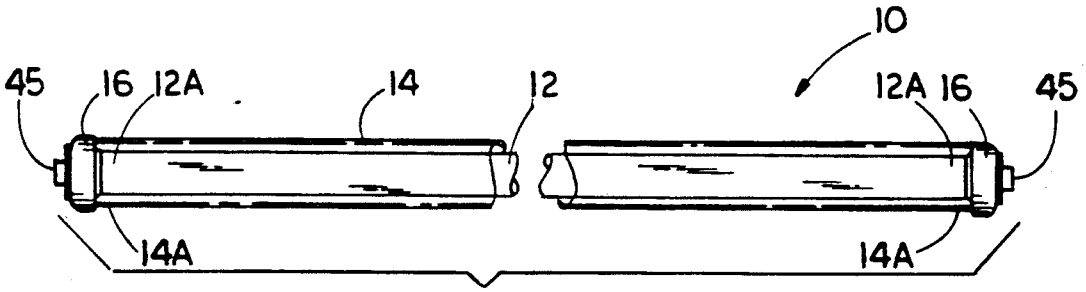
FIG. 1 is a foreshortened longitudinal elevational view of a prior art elongated jacketed fluorescent lamp having a pair of prior art end cap assemblies.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

PRIOR ART END CAP ASSEMBLY

Referring now to the drawings, and particularly to FIG. 1, there is illustrated a prior art elongated jacketed discharge lamp, such as a jacketed fluorescent lamp, generally designated 10. Being generally similar to the embodiment disclosed in above-cited U.S. Pat. No. 3,453,470 to Hammer, the lamp 10 includes an elongated discharge envelope tube 12, an outer elongated light or radiation-transmitting sleeve 14, such as made of glass, which surrounds and is spaced radially outwardly from the envelope tube 12, and a pair of end cap assemblies 16 mounted to and protecting respective opposite ends 12A of the envelope tube 12 and supporting opposite ends 14A of the outer sleeve 14. The outer sleeve 14 encloses an air space which serves to thermally insulate the envelope tube 12 from external cooling air flow and ambient temperature conditions. Hence, the shielding and insulating effects of the outer sleeve 14 and trapped air on the envelope tube 12 aid in stabilizing and starting an arc discharge within the tube 12.

Ordinarily the discharge envelope tube 12 is a fluorescent tube in which case the envelope tube 12, being made of glass, is coated on its interior surface with a light-emitting phosphor (not shown). However, the envelope tube 12 could be other than fluorescent, for instance a germicidal lamp for use in cold storage rooms for controlling or reducing mold formation on meat and foodstuffs. In such case, the outer sleeve 14 would consist of quartz or an ultraviolet radiation-transmitting glass or other suitable material. Also, the outer sleeve 14 could be made of a high impact strength non-yellowing transparent plastic material to shield the envelope tube 12 against insects or objects thrown by vandals.

Figure 2:
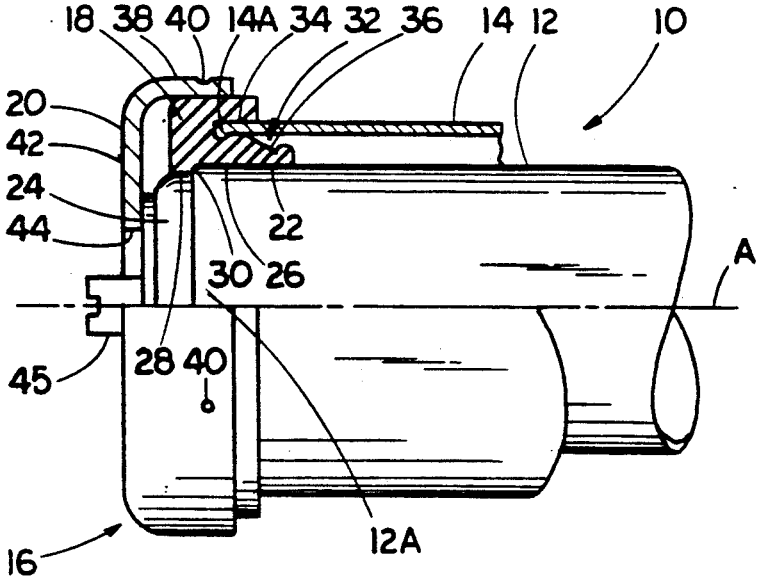
FIG. 2 (PRIOR ART)
FIG. 2 is an enlarged fragmentary side elevational view, with some portions sectioned and other portions broken away, of one of the prior art end cap assemblies on one of the ends of the jacketed fluorescent lamp of FIG. 1.
Figure 4:
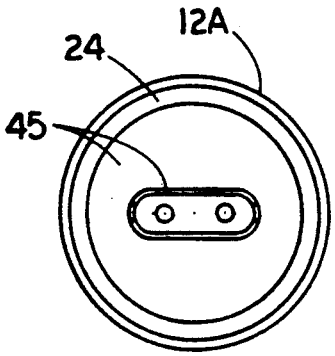
FIG. 4 is an end elevational view of the base end of the discharge envelope tube as seen along line 4—4 of FIG. 3.
Figure 3:
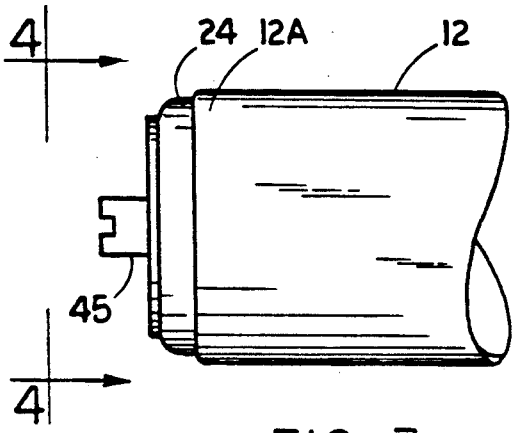
FIG. 3 is a view similar to that of FIG. 2, but illustrating a base end on an elongated discharge envelope tube of the prior art jacketed fluorescent lamp without the end cap assembly and an outer glass sleeve.

Referring to FIGS. 2–4, each end cap assembly 16 includes an annular spacer 18 and an annular end cap 20. The annular spacer 18 of the end cap assembly 16 is composed of a thermally insulating material, preferably rubber or a resilient rubber-like material, and has a bore 22 to receive one of the ends 12A of the envelope tube 12 and a base end 24 thereon in a frictionally fitted or engaged relationship. The bore 22 is defined by first and second tandemly-arranged annular interior wall surfaces 26, 28 of the annular spacer 18. The first annular interior wall surface 26 which surrounds and is frictionally engaged with the periphery of the one end 12A of the envelope tube 12 has a larger diameter than the second annular interior wall surface 28 which surrounds and is frictionally engaged with the periphery of the base 24 on the one end 12A of the envelope tube 12. Also, the annular spacer 18 has an annular interior shoulder 30 which provides a transition wall surface extending between the first and second annular interior wall surfaces 26, 28. The annular interior shoulder 30 defines a stop for engagement with a peripheral corner edge 12B on the end 12A of the envelope tube 12 so as to prevent over-insertion of the tube end 12A into the bore 22.

The annular spacer 18 of the end cap assembly 16 also contains a narrow annular groove 32 which receives and seats one end 14A of the outer sleeve 14. As shown in the drawings, normally each end 14A of the outer sleeve 14 contains an internal bead or beveled lip which is inherent in the forming of the outer sleeve when it is of a glass material. The groove 32 is a gap defined between annular outer and inner wall surfaces 34, 36 which has a width substantially the same or slightly smaller than the thickness of the end 14A of the outer sleeve 14 such that the exterior and interior of the sleeve end 14A frictionally engages both the annular outer and inner wall surfaces 34, 36 when inserted between them into the groove 32. As shown, the inner wall surface 36 slopes radially inwardly toward the inward receiving end of the bore 22 to facilitate insertion of the jacket end 14A into the groove 32 during assembly. Also, the annular inner wall surface 36 has a greater axial length than the annular outer wall surface 34 relative to a longitudinal axis A of the end cap assembly 16.

The annular end cap 20 of the end cap assembly 16 is in the form of a cup-shaped metal shell having an annular skirt or sidewall 38 which is force-fitted about and is indented at 40 to grip the periphery of the annular insulating spacer 18 to put the spacer 18, outer sleeve end 14A and envelope tube end 12A in compression to assure a rigid assembly. The end cap 20 also has a face or end wall 42 which overlies the base 24 on the end 12A of the discharge envelope tube 12 sealing off any empty space. The end wall 42 defines a central aperture 44 through which protrudes an annular contact-shielding housing 45, generally of an oval or race-track shape, which projects from the base 24 of the tube end 12A.

IMPROVED ONE-PIECE SPACER END CAP OF THE INVENTION

Referring to FIGS. 5–9, there is illustrated two slightly different embodiments of an improved spacer end cap, generally designated 46, of the present invention for mounting to each end of an otherwise conventional elongated jacketed discharge lamp 10. The spacer end cap 46 basically includes a one-piece body of a thermally insulating material having a central longitudinal axis B and an annular ring-shaped skirt or side portion 48 and an annular disk-shaped end portion 50 integrally-connected therewith. The annular side and end portions 48, 50 preferably are made as a single part from a single piece of rubber or other thermally insulating resiliently flexible material. Also, the annular side and end portions 48, 50 are disposed symmetrically along and about the longitudinal axis B of the one-piece body.

Figure 5:
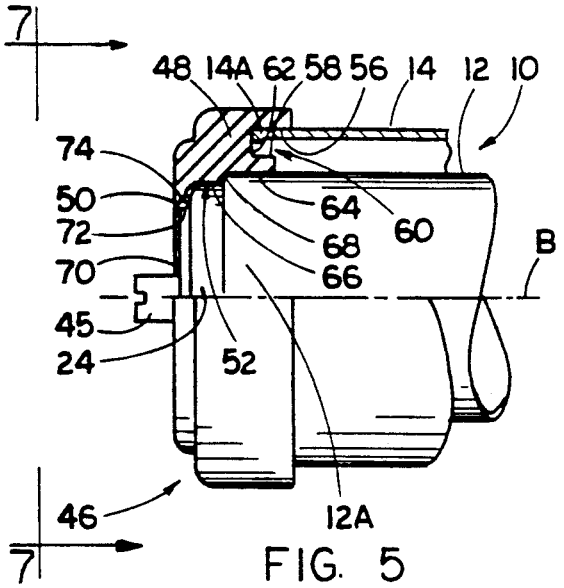
FIG. 5 is a view similar to that of FIG. 2, but showing a first embodiment of a spacer end cap of the present invention on one of the ends of the jacketed fluorescent lamp.
Figure 6:
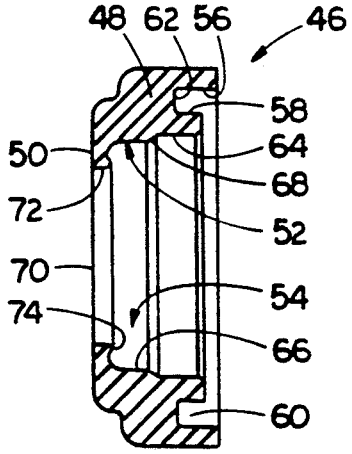
FIG. 6 is a cross-sectional view of the spacer end cap of FIG. 5.
Figure 7:
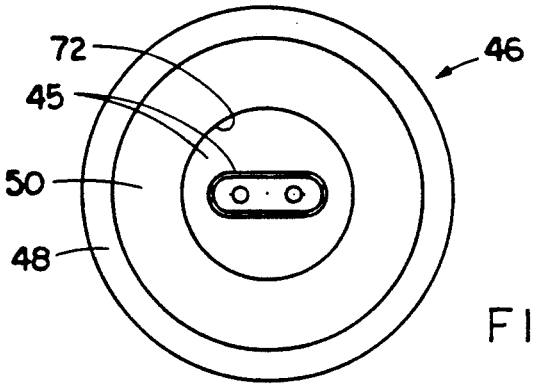
FIG. 7 is an end elevational view of the jacketed fluorescent lamp having the spacer end cap of the present invention mounted thereon as seen along line 7—7 of FIG. 5.
Figure 8:
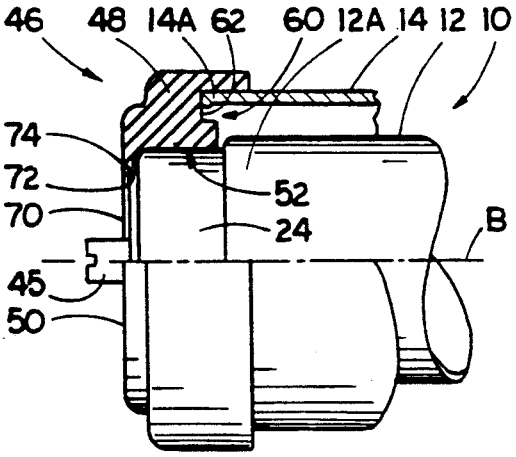
FIG. 8 is a view similar to that of FIG. 5, but showing a second modified embodiment of the spacer end cap of the present invention.

More particularly, the annular side portion 48 has an annular interior wall surface 52 defining a cylindrical central cavity 54 which receives and frictionally engages either both the peripheries of the base 24 and of end 12A of the envelope tube 12, as seen in FIG. 5 or just the periphery of the base 24, as seen in FIG. 8. Also, the annular side portion 48 has a spaced pair of outer and inner annular wall surfaces 56, 58 defining an annular groove 60 therebetween. The annular groove 60 is open in a direction facing away from the annular end portion 50 of the end cap 46 and has an annular bottom wall surface 62 extending between and connecting the outer and inner annular wall surfaces 56, 58. Preferably, the outer annular wall surface 56 is greater in axial length than the inner annular wall surface 58 along the longitudinal axis B of the one-piece body of the end cap 46.

The annular groove 60 removably receives and seats one end 14A of the outer sleeve 14. The annular groove 60 defines an annular gap in the annular side portion 48 between the outer and inner annular wall surfaces 56, 58 thereof which has a width substantially greater than the thickness of the sleeve end 14A. The outside diameter of the sleeve end 14A is slightly greater than the inside diameter of the outer annular wall surface 56 of the annular side portion 48 such that the outer annular wall surface 56 surrounds and frictionally engages the exterior of the outer sleeve end 14A, whereas the inner annular wall surface 58 is spaced radially inwardly from the interior of the outer sleeve end 14A away from frictional engagement therewith.

Figure 9:
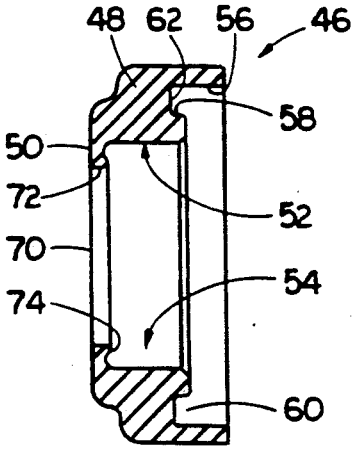
FIG. 9 is a cross-sectional view of the spacer end cap of FIG. 8.

In the embodiment seen in FIGS. 8 and 9, the annular interior wall surface 52 of the annular side portion 48 defining the central cavity 54 is of a constant diameter size along the longitudinal axis B of the one-piece body of the end cap 46. On the other hand, in the embodiment seen in FIGS. 5–7, the annular interior wall surface 52 of the annular side portion 48 defining the central cavity 54 includes first and second tandemly-arranged annular interior wall surface portions 64, 66. The first annular interior wall surface portion 64 surrounds and frictionally engages the periphery of the envelope tube end 12A, whereas the second annular interior wall surface portion 66 surrounds and frictionally engages the periphery of the base 24 on the envelope tube end 12A. The first annular interior wall portion 64 is greater in diameter than the second annular interior wall portion 66 such that an annular interior shoulder portion 68 extends between the first and second annular interior wall portions 64, 66 to provide a transition wall surface defining a stop capable of engagement with a peripheral corner edge 12B on the envelope tube end 12A so as to prevent over-insertion thereof into the central cavity 54 of annular side portion 48.

Further, the annular end portion 50 of the spacer end cap 46 has an annular inner lip or rim 70 which defines a central aperture 72 through which protrudes the annular contact-shielding housing 45 projecting from the base 24 on the envelope tube end 12A. The annular inner rim 70 surrounds the annular housing 45 and includes an inner annular lip 74 that protrudes inwardly from the plane of the annular rim 70 for flexurally sealing against the envelope tube base 24. The central cavity 54 defined by the annular side portion 48 is greater in diameter than the central aperture 72 defined by the annular end portion 50.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. A one-piece, thermally insulating spacer end cap for mounting to an end of an elongated jacketed discharge lamp to thermally insulate the end portions of said lamp from the environment, said spacer end cap comprising:

(a) a one-piece body of thermally insulating material having a central longitudinal axis and an annular ring-shaped side portion and an annular disk-shaped end portion integrally-connected therewith, said annular side and end portions disposed symmetrically about said longiudinal axis;

(b) said annular side portion having an annular interior wall surface defining a central cavity capable of receiving and frictionally engaging at least a periphery of a base on an end of an envelope tube of the jacketed discharge lamp;

(c) said annular side portion also has a spaced pair of outer and inner annular wall surfaces defining an annular groove therebetween capable of receiving and seating one end of an outer sleeve which surrounds the envelope tube of the jacketed lamp, said outer annular wall surface of said annular side portion capable of surrounding and frictionally engaging the exterior of the one end of the outer sleeve as said inner annular wall surface is spaced radially inwardly from the interior of the end of the outer sleeve away from frictional engagement therewith;

(d) said annular end portion defining a central aperture through which protrudes an annular contact-shielding housing projecting from the base on the envelope tube end, wherein said annular interior wall surface of said annular side portion defining said central cavity includes first and second tandemly-arranged annular interior wall surface portions, said first annular interior wall surface portion capable of surrounding and frictionally engaging the periphery of the one end of the envelope tube, said second annular interior wall surface portion capable of surrounding and frictionally engaging the periphery of the base on the one end of the envelope tube, and wherein said first annular interior wall portion is greater in diameter than said second annular interior wall portion.

2. The spacer end cap as recited in claim wherein said annular groove defines an annular gap in said annular side portion between said outer and inner annular wall surfaces thereof having a width substantially greater than the thickness of the sleeve end.

3. The spacer end cap as recited in claim 1, wherein said outer annular wall surface is greater in axial length than said inner annular wall surface along said longitudinal axis of said one-piece body.

4. The spacer end cap as recited in claim 1, wherein said annular end portion has an annular inner rim defining said central aperture and sealably surrounding the annular housing, said annular inner rim overlying a peripheral edge of the envelope tube end base.

5. The spacer end cap as recited in claim 1, wherein said central cavity defined by said annular side portion is greater in diameter than said central aperture defined by said annular end portion.

6. The spacer end cap as recited in claim 1, wherein said annular interior wall surface of said annular side portion defining said central cavity is of a constant diameter size along said longitudinal axis of said one-piece body.

7. The spacer end cap as recited in claim 1, wherein said annular side portion includes an annular interior shoulder portion extending between said first and second annular interior wall portions to provide a transition wall surface defining a stop capable of engagement with a peripheral corner edge on the one end of the envelope tube so as to prevent over-insertion thereof into said central cavity of said annular side portion.

8. In combination with an elongated jacketed discharge lamp having an elongated discharge envelope tube, a base attached on opposite ends of said envelope tube, an annular electrical contact-shielding housing mounted on and protruding outwardly from said base, and an outer light-transmitting sleeve having opposite ends and surrounding and spaced radially outward from said envelope tube, a one-piece thermally insulating spacer end cap for thermally insulating said opposite ends of said lamp from the environment, said spacer end cap comprising:

(a) a one-piece body of thermally insulating material having a central longitudinal axis and an annular ring-shaped side portion and an annular disk-shaped end portion integrally-connected therewith, said annular side and end portions disposed symmetrically about said longitudinal axis;

(b) said annular side portion having an annular interior wall surface defining a central cavity receiving and frictionally engaging at least a periphery of said base on said end of said envelope tube;

(c) said annular side portion also has a spaced pair of outer and inner annular wall surfaces defining an annular groove therebetween receiving and seating one of said opposite ends of said outer sleeve, said outer annular wall surface of said annular side portion surrounding and frictionally engaging the exterior of said one end of the outer sleeve as said inner annular wall surface is spaced radially inwardly from the interior of said one end of said outer sleeve away from frictional engagement therewith;

(d) said annular end portion defining a central aperture through which protrudes said annular contact-shielding housing projecting from said base on said envelope tube end, wherein said annular interior wall surface of said annular side portion defining said central cavity includes first and second tandemly-arranged annular interior wall surface portions, said first annular interior wall surface portion surrounding and frictionally engaging the periphery of said one end of said envelope tube, said second annular interior wall surface portion surrounding and frictionally engaging the periphery of said base on said one end of said envelope tube, and wherein said first annular interior wall portion is greater in diameter than said second annular interior wall portion.

9. The spacer end cap as recited in claim 8, wherein said annular groove defines an annular gap in said annular side portion between said outer and inner annular wall surfaces thereof having a width substantially greater than the thickness of the sleeve end.

10. The spacer end cap as recited in claim 8, wherein said outer annular wall surface is greater in axial length than said inner annular wall surface along said longitudinal axis of said one-piece body.

11. The spacer end cap as recited in claim 8, wherein said annular end portion has an annular inner rim defining said central aperture and sealably surrounding said annular housing, said annular inner rim overlying a peripheral edge of said envelope tube end base.

12. The spacer end cap as recited in claim 8, wherein said central cavity defined by said annular side portion is greater in diameter than said central aperture defined by said annular end portion.

13. The spacer end cap as recited in claim 8, wherein said annular interior wall surface of said annular side portion defining said central cavity is of a constant diameter size along said longitudinal axis of said one-piece body.

14. The spacer end cap as recited in claim 8, wherein said annular side portion includes an annular interior shoulder portion extending between said first and second annular interior wall portions to provide a transition wall surface defining a stop engaging a peripheral corner edge on said one end of the envelope tube so as to prevent over-insertion thereof into said central cavity of sand annular side portion.

* * * * *